United States Patent [19]

Dropinski

[11] 4,229,890

[45] Oct. 28, 1980

[54] PICTURE-MAKING EASEL AND FRAME

[76] Inventor: Marion Dropinski, 1305 Hartford St., Colorado Springs, Colo. 80906

[21] Appl. No.: 909,543

[22] Filed: May 25, 1978

[51] Int. Cl.[3] ..... D05C 1/02; D06C 3/08

[52] U.S. Cl. ..... 38/102.1; 28/149; 38/102.91

[58] Field of Search ..... 38/102.1, 102.3, 102.4, 38/102.91; 28/149, 150, 151, 152; 289/1.5, 18 M; 160/38; 248/163, 455

[56] References Cited

U.S. PATENT DOCUMENTS

| | | | |
|---|---|---|---|
| 1,708,770 | 4/1929 | McConnell | 160/380 |
| 2,691,203 | 10/1954 | Wilder | 28/149 |
| 2,723,439 | 11/1955 | Doniger | 28/151 |
| 3,971,109 | 7/1976 | Garza | 28/151 |
| 4,102,065 | 7/1978 | Selden | 28/149 |

FOREIGN PATENT DOCUMENTS

| | | | |
|---|---|---|---|
| 4377 | of 1888 | United Kingdom | 38/102.4 |

*Primary Examiner*—Louis Rimrodt

[57] ABSTRACT

An apparatus upon which a fabric is supported in a stretched condition, in order to be flat while a pictorial design is sewn thereupon, with beads and sequins; the apparatus including an upright easel supporting a freely pivotable frame, that holds the fabric, the upper end of the easel having a lamp and shade for floodlighting the work, and the frame also supporting a set of cups, within which different colors of beads and sequins are retained, during the work.

1 Claim, 7 Drawing Figures

PICTURE-MAKING EASEL AND FRAME

This invention relates generally to needlework equipment. More specifically, it relates to a weaving frame.

A principal object of the present invention is to provide a picture-making easel and frame, for holding a cloth or other fabric in a taut, flat condition, so that pictures or designs can be sewn thereupon out of beads and sequins.

Another object of the present invention is to provide a picture-making easel and frame, which can be utilized to do needlepoint and embroidery work.

Another object is to provide a picture-making easel and frame, that includes a set of cups in addition to the frame that holds the fabric, the cups holding various colored beads and sequins, so as to be handy, thus freeing the person's hands from holding the fabric, and holding the beads and sequins, so that the hands are unencumbered for performing the sewing operation.

Yet a further object is to provide a picture-making easel and frame, which includes a floodlight for illuminating the work being performed.

Other objects are to provide a picture-making easel and frame, which is simple in design, inexpensive to manufacture, rugged in construction, easy to use and efficient in operation.

These, and other objects, will be readily evident, upon a study of the following specification, and the accompanying drawing, wherein.

Figure 1:
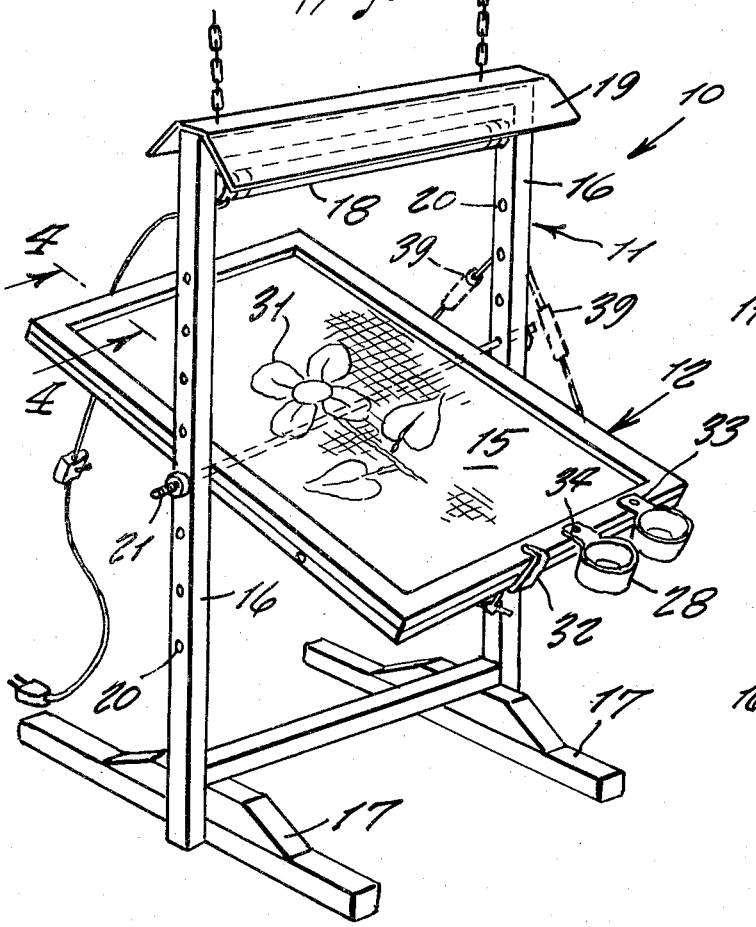
FIG. 1 is a perspective view of the present invention.

Referring now to the drawing in greater detail, the reference numeral 10 represents a picture-making easel and frame, according to the present invention, wherein there is an upright easel 11, which adjustably supports a frame unit 12, comprised of upper and lower frames 13 and 14, for supporting a fabric 15 therebetween.

The easel 11 includes vertical side legs 16, mounted upon feet 17, the upper ends of the legs supporting a neon lamp 18 therebetween, which is covered by a light shield for reflector 19.

Figure 2:
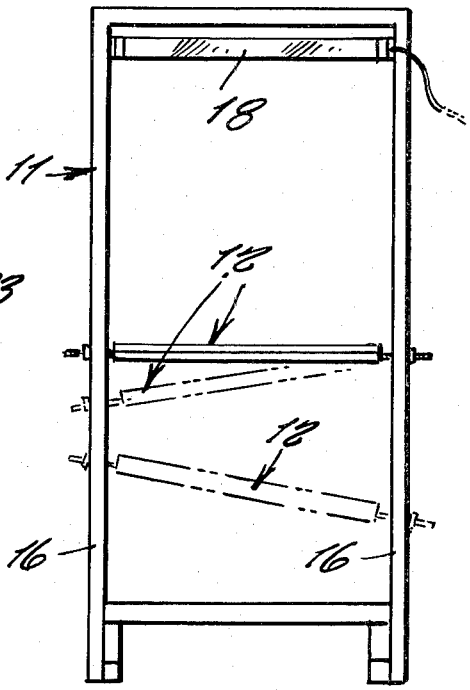
FIG. 2 is a side view thereof, shown without the light shield, and illustrating various adjustable tilted positions of the frame unit.
Figure 3:
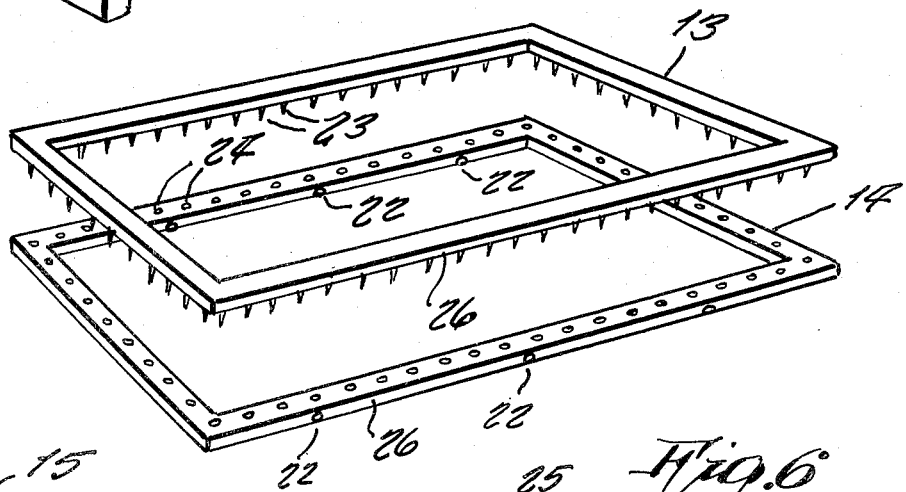
FIG. 3 illustrates the frames separated.
Figure 4:
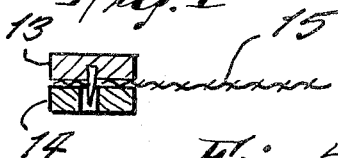
FIG. 4 is an enlarged cross-section, on line 4—4 of FIG. 1.

A row of spaced apart openings 20 are located along each leg 16, in order to selectively receive a bolt 21, that is passed through selective openings 22 of the frame 14, in order to pivotally support the frame unit upon the easel. As shown in FIG. 2, the frame unit may be supported either in a level position between the legs, or it may be tilted in either direction, as indicated by the phantom lines.

The frame 13 includes downwardly extending nails 23, that are receivable within openings 24 of the frame 14.

A groove 25, along an edge 26 of each frame 13 and 14, serves to receive opposite ends of an accordion-pleated clip 27, for purposes of retaining the frames together. The cup 28 is permanently affixed upon a second accordion-pleated clip 29, which snaps into the clip 27, as is clearly shown by arrows 30 in FIG. 6. Thus, the frames can be held together, and also support a plurality of cups 28, in each one of which a different color of beads or sequins are placed, so as to be handy to a person who is weaving a design 31 upon the fabric 15.

Figure 6:
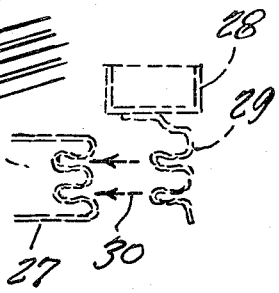
FIG. 6 shows an alternate method of attaching the frames together, and securing bead and sequin cups thereto.

Alternately, as shown in FIG. 1, instead of the clips and cups shown in FIG. 6, the device may be made as shown in FIG. 1, wherein a conventional clamp 32 is utilized, for clamping the frames together, and the cups 28 may each include a short handle 33, through which a nail 34 secures the cups to the frame unit.

Figure 7:
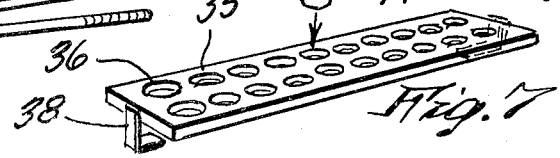
FIG. 7 illustrates another design for supporting cups of beads and sequins.

Alternately, as shown in FIG. 7, a board 35 has a large number of openings 36, in each of which a flanged cup 37 is receivable, opposite ends of the board being fitted with angle shaped brackets 38, so as to clip around opposite side edges of the frame unit. Thus, in this design, a large number of cups can be slided along the frame units, so as to be closely handy in use.

Figure 5:
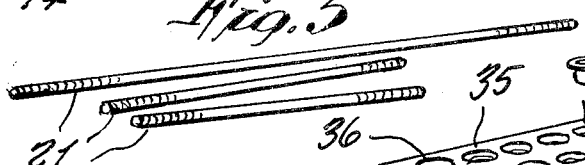
FIG. 5 illustrates three bolts interchangeably used to support the frame unit.

Tie-bolts 39, each incorporating a turn-buckle, may be utilized for rigidly affixing the frame unit upon the easel, so as to prevent the same from pivoting about the bolt 21. FIG. 5 indicates that different lengths of bolts may be utilized, as wished, depending upon the tilted angle of the frame units that is desired.

While various changes may be made in the detail construction, it is understood that such changes will be within the spirit and scope of the present invention, as is defined by the appended claims.

What I now claim is:

1. An adjustable easel and frame unit for supporting needlework and the like comprising:

A. a pair of vertical side legs having feet at the lower ends thereof;

B. lamp means mounted between upper ends of said legs;

C. spaced-apart openings located along each leg in order to selectively receive a bolt;

D. a frame unit pivotally supported upon said easel by said bolt;

E. said frame unit comprises upper and lower frame means, said upper means including a plurality of downwardly extending nails and said lower means including a plurality of openings into which said nails are receivable, whereby needlework may be retained in a stretched condition between said frame means by said nails of said upper frame passing through said needlework into the openings of the lower frame;

F. means for clamping said upper and lower frames means together; and;

G. cup means supported upon said frame unit for holding needle-working material.

* * * * *